US006575707B2

(12) United States Patent
Matt et al.

(10) Patent No.: US 6,575,707 B2
(45) Date of Patent: Jun. 10, 2003

(54) AIR COMPRESSOR HAVING THERMAL VALVE

(75) Inventors: Gunter Matt, Charlotte, NC (US); Balasubramanian Manickam, Huntersville, NC (US)

(73) Assignee: Ingersoll-Rand Company, Woodcliff Lake, NJ (US)

( * ) Notice: Subject to any disclaimer, the term of this patent is extended or adjusted under 35 U.S.C. 154(b) by 0 days.

(21) Appl. No.: 10/008,527

(22) Filed: Nov. 5, 2001

(65) Prior Publication Data

US 2003/0086793 A1 May 8, 2003

(51) Int. Cl.[7] ..... F04B 39/04; F04B 39/06

(52) U.S. Cl. ..... 417/228; 236/34.5; 236/93 A; 165/297; 165/300

(58) Field of Search ..... 417/228; 236/34.5, 236/93 A; 165/297, 300

(56) References Cited

U.S. PATENT DOCUMENTS

| | | | | |
|---|---|---|---|---|
| 3,051,194 A | | 8/1962 | Henrichsen | |
| 3,332,436 A | | 7/1967 | Welty | |
| 3,734,405 A | * | 5/1973 | Wagner | 236/34.5 |
| 3,741,477 A | * | 6/1973 | Sparks | 236/34.5 |
| 4,036,433 A | | 7/1977 | Wagner et al. | |
| 4,055,298 A | * | 10/1977 | Wilson | 123/41.09 |
| 4,112,974 A | | 9/1978 | Davis et al. | |
| 4,196,847 A | * | 4/1980 | Gobien | 236/100 |
| 4,288,033 A | * | 9/1981 | Wisyanski | 236/100 |
| 4,325,217 A | | 4/1982 | Golestaneh | |
| 4,685,651 A | | 8/1987 | Nouvelle et al. | |
| 4,748,941 A | | 6/1988 | Kashiwase | |
| 5,427,062 A | | 6/1995 | Chamot et al. | |
| 5,676,308 A | | 10/1997 | Saur | |
| 5,727,729 A | | 3/1998 | Hutchins | |
| 5,791,557 A | | 8/1998 | Kunze | |
| 5,974,827 A | | 11/1999 | Hosking et al. | |
| 5,979,778 A | | 11/1999 | Saur | |
| 5,984,195 A | | 11/1999 | Benedict | |
| 6,109,588 A | | 8/2000 | Cerrano | |
| 6,439,467 B2 | * | 8/2002 | Mabboux et al. | 236/34.5 |
| 2002/0043224 A1 | * | 4/2002 | Richter | 123/41.1 |
| 2002/0066794 A1 | * | 6/2002 | Wolber et al. | 236/34.5 |
| 2002/0096571 A1 | * | 7/2002 | Kunze et al. | 236/34.5 |

* cited by examiner

*Primary Examiner*—Cheryl J. Tyler
*Assistant Examiner*—W Rodriguez
(74) *Attorney, Agent, or Firm*—Michael Best & Friedrich LLP

(57) ABSTRACT

A compressor system includes a fluid system having a cooler and a valve. The valve includes a housing and a spool disposed within the housing. The spool has a temperature sensitive wax cartridge, and is movable between an actuated position and a non-actuated position. When the spool is in the actuated position, inlet fluid flow enters the valve through an inlet port, exits the valve through the cooler port, flows through the cooler, reenters the valve through the cooler return, flows over the wax cartridge, and exits the valve through the outlet port. When the spool is in the non-actuated position, the inlet fluid flow bypasses the cooler, flows through the valve and over the wax cartridge, and exits the valve through the outlet port. The wax cartridge only senses the temperature of the inlet fluid flow when the spool is in the non-actuated position.

32 Claims, 4 Drawing Sheets

AIR COMPRESSOR HAVING THERMAL VALVE

FIELD OF THE INVENTION

This invention relates to compressor systems, and more particularly to air compressor systems.

BACKGROUND OF THE INVENTION

Prior art air compressors typically include a compressor, a motor to drive the compressor and a coolant system to cool the air discharged by the compressor and the components of the compressor. The compressor generally compresses air to pressures above normal atmospheric pressures. The coolant system includes a cooler and a bypass valve. In some prior art arrangements, the bypass valve is a temperature sensitive thermal valve. FIG. 5 illustrates a prior art thermal bypass valve 10 in a non-actuated position, in which coolant, normally oil, bypasses the cooler. FIG. 6 illustrates the thermal bypass valve in the actuated position, in which coolant is directed to the cooler.

In FIGS. 5 and 6, the valve 10 has an inlet 14 from the coolant system, an outlet 18 to the coolant system, a cooler exit 22, and a cooler return 26. The cooler is a heat exchanger that cools the coolant. The valve 10 includes a spool 30 and a wax cartridge 34 interconnected to the spool 30. The wax cartridge 34 is directly exposed to the coolant flow from the inlet in both the non-actuated position (FIG. 5) and the actuated position (FIG. 6). The wax cartridge 34 senses the inlet fluid temperature of the coolant. In the non-actuated position illustrated in FIG. 5, the coolant flow enters the valve 10 through the inlet 14, and exits through the outlet 18. The valve 10 is generally in the non-actuated position when the inlet fluid temperature is below a predetermined level. As the inlet fluid temperature increases above a predetermined level, the wax cartridge 34 expands and actuates the valve 10 to the actuated position, illustrated in FIG. 6. When the valve 10 is in the actuated position, the coolant flow enters the valve 10 through the inlet 14, exits the valve 10 through the cooler exit 22, flows through the cooler, reenters the valve 10 through the cooler return 26, and exits the valve 10 through the outlet 18. In both the actuated (FIG. 6) and non-actuated positions (FIG. 5), the wax cartridge 34 is directly exposed to the coolant flow from the inlet 14. The wax cartridge 34 senses the inlet fluid flow, and the temperature of the inlet coolant flow influences the wax cartridge 34 when the spool 30 is in both the actuated and non-actuated position.

The temperature of the inlet fluid flow is relatively unstable and fluctuates over a range of temperatures. As the inlet temperature fluctuates up and down, the wax cartridge senses the inlet fluid temperature and moves the spool 30 back and forth between the actuated position and the non-actuated position. This fluctuation of the inlet temperature and movement of the spool 30 is undesirable and creates additional wear and tear on the components of the valve 10, and inconsistent fluid flow through the cooler. Additionally, the fluctuation of the inlet temperature creates an inconsistent outlet temperature.

SUMMARY OF THE INVENTION

The invention provides a thermal valve for a compressor system wherein the wax cartridge senses the temperature of the inlet fluid flow only when the spool is in the non-actuated position. The wax cartridge does not sense the temperature of the inlet fluid flow when the spool is in the actuated position. The wax cartridge senses the temperature of the outlet fluid flow when the valve is in the actuated position. The temperature of the outlet fluid flow from the cooler is relatively stable, and does not fluctuate as much as the inlet fluid temperature.

Figure 1:
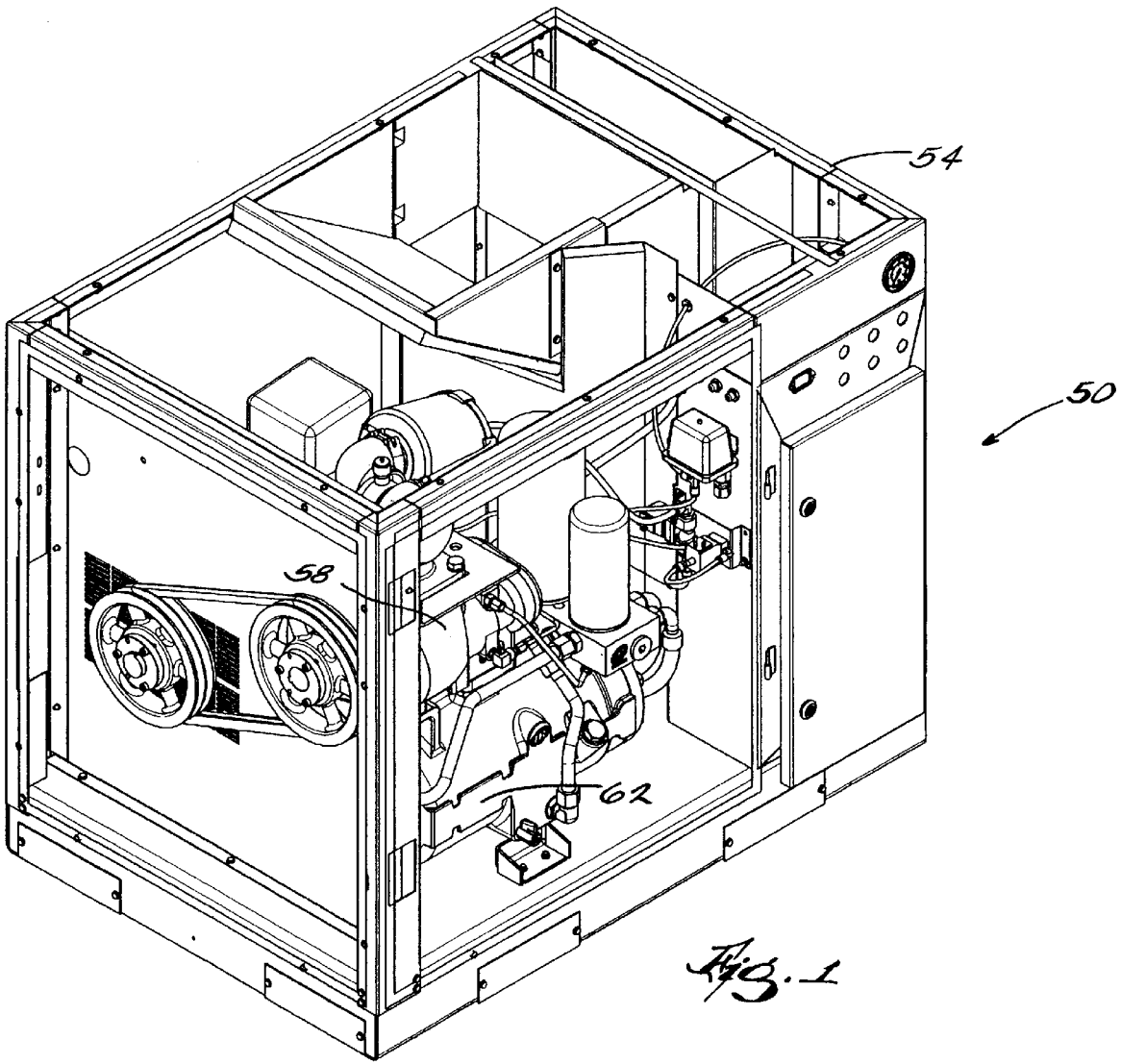
FIG. 1 is a perspective view of a compressor system embodying the invention.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

Although references are made below to directions, such as left, right, up, down, top, bottom, front, rear, back etc., in describing the drawings, they are made relative to the drawings (as normally viewed) for convenience. These directions are not intended to be taken literally or limit the present invention in any form.

DETAILED DESCRIPTION

FIG. 1 illustrates a compressor system 50 disposed within an enclosure 54. The compressor system 50 includes an airend 58 and a separator tank 62. The airend 58 compresses air to pressures above normal atmospheric pressures, and the pressurized air flows from the airend 58 to the separator tank 62. In the separator tank 62, oil is separated from the pressurized air.

Figure 2:
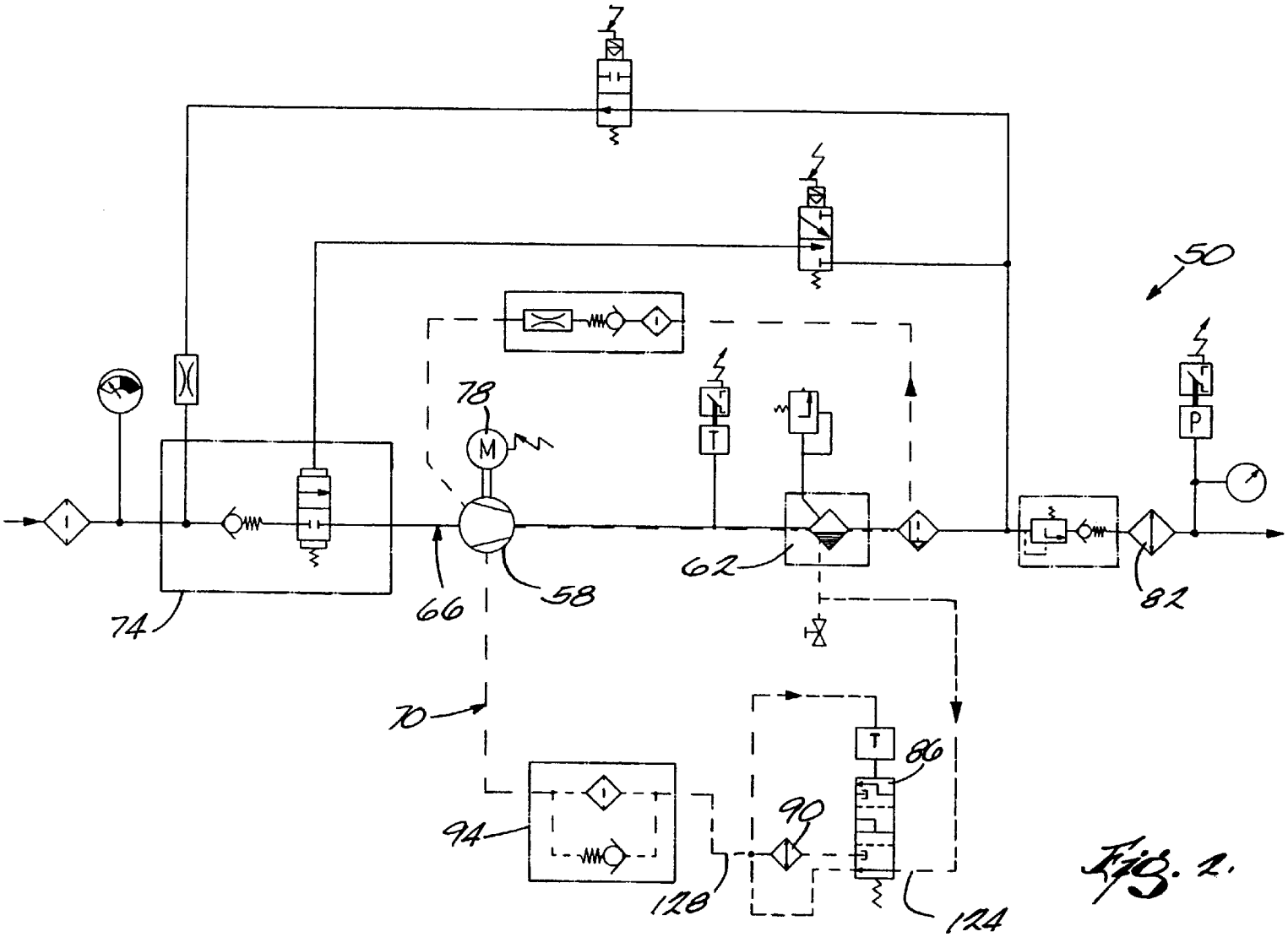
FIG. 2 is a schematic illustration of the compressor of FIG. 1.

FIG. 2 illustrates a schematic diagram of the compressor system 50. FIG. 2 shows the flow path of air through an air system 66, and the flow path of oil or other fluid through a fluid system 70. In the illustrated embodiment, the fluid system 70 is a coolant system for the compressor system 50, and the fluid or coolant flowing through the fluid system 70 is oil.

Air enters the air system 66 through an air intake 74 and flows to the airend 58, which compresses the air into pressurized air. In the illustrated embodiment, a motor 78 drives the airend 58. Oil from the fluid system 70 is mixed with the pressurized air in the airend 58. The pressurized air and oil mixture flows from the airend 58 to the separator tank 62, and the oil is separated from the pressurized air in the separator tank 62. From the separator tank 62, the pressurized air flows to an aftercooler 82 that cools the pressurized air, and the pressurized air then proceeds to the desired application.

From the separator tank 62, the separated fluid flows through the fluid system 70 to a thermal valve 86 that senses the fluid temperature and directs the fluid to a cooler 90, or bypasses the cooler 90 and directs the fluid to the fluid system 70. If the fluid temperature is above a predetermined level, the valve 86 will direct the fluid to the cooler 90. The cooler 90 is a heat exchanger that lowers the temperature of the fluid. If the fluid temperature is below a predetermined level, the valve 86 will bypass the cooler 90 and direct the fluid flow to the fluid system 70 where the fluid proceeds through a filter 94 and back to the airend 58.

Figure 3:
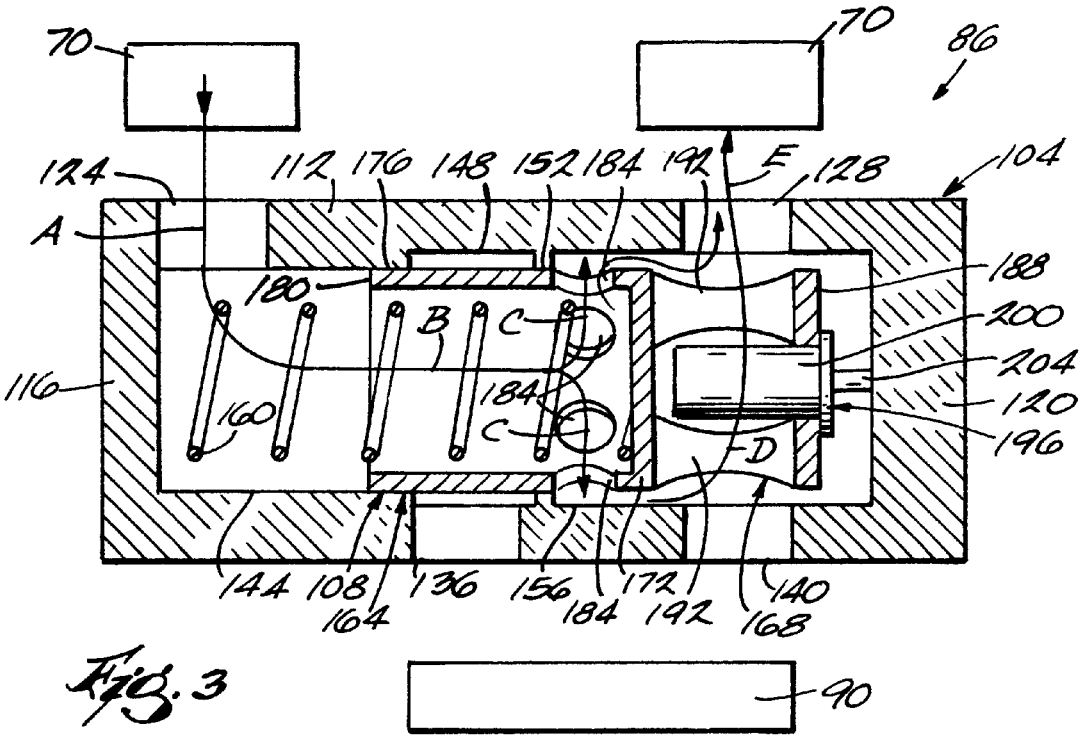
FIG. 3 is a cross-sectional view of a thermal valve of the compressor of FIG. 1.
Figure 4:
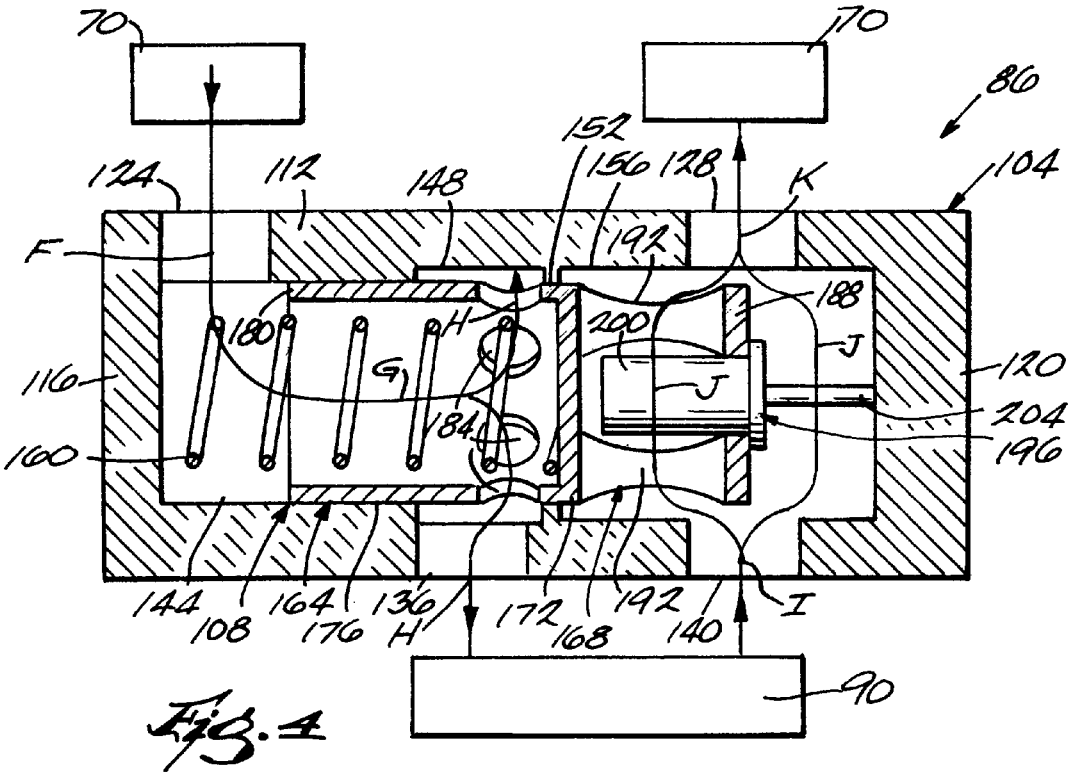
FIG. 4 is a cross-sectional view of the thermal valve of the compressor of FIG. 3.

FIG. 3 illustrates the thermal valve 86 in greater detail. Generally, thermal valves may be diverting valves or mixing valves. Diverting valves sense the relatively hot inlet temperature, and direct the fluid flow through the valve according to the hot side inlet temperature. Mixing valves sense the relatively cool outlet temperature, and direct the fluid flow through the valve according to the cool side outlet temperature. The valve 86 is generally a mixing valve. The valve 86 includes a valve housing 104 and a spool 108 disposed within the housing 104. The spool 108 is movable within the housing 104 between a non-actuated position (FIG. 3) and an actuated position (FIG. 4). FIG. 3 illustrates the spool 108 in the non-actuated position, and FIG. 4 illustrates the spool 108 in the actuated position.

The housing 104 is a cylindrical tube having a cylindrical side wall 112, an inlet end 116 at one end of the housing 104, and an outlet end 120 at the end of the housing 104 opposite the inlet end 116. An inlet port 124 is an opening in the side wall 112 near the inlet end 116, and an outlet port 128 is an opening in the side wall 112 near the outlet end 120. Fluid flows from the fluid system 70 into the valve 86 through the inlet port 124, and fluid exits the valve 86 and flows back to the fluid system 70 through the outlet port 128.

The valve 86 is sensitive to the fluid temperature, and directs the fluid flow to the cooler 90 or the fluid system 70 depending on the temperature of the fluid. The housing 104 has a cooler port 136 leading from the valve 86 to the cooler 90, and a cooler return 140 leading from the cooler 90 back to the valve 86. The cooler return 140 is an opening in the side wall 112 near the outlet end 120. In the illustrated embodiment, the cooler return 140 is disposed on the side of the housing 104 opposite the outlet port 128. The cooler port 136 is a opening in the side wall 112 disposed between the inlet end 116 and outlet end 120. In the illustrated embodiment, the cooler port 136 is on the same side of the housing 104 as the cooler return 140.

The housing 104 is a cylindrical tube, and the interior of the housing 104 is an open cavity. The inner diameter of the side wall 112 varies along the length of the housing 104 to create multiple chambers or passages through the valve 86. In FIGS. 3 and 4, the side wall 112 has an inner surface 144 having a substantially uniform inner diameter that extends from the inlet port 124 to the cooler port 136. Near the cooler port 136, the inner diameter of the side wall 112 increases and forms a first chamber 148. The inner surface 144 extends from the inlet end 116 to the first chamber 148. The inner diameter of the first chamber 148 is greater than the inner diameter of the inner surface 144.

A middle ridge 152 extends radially inwardly from the side wall 112 between the cooler port 136 and the cooler return 140. The inner diameter of the middle ridge 152 is less than the diameter of the first chamber 148, and similar to the diameter of the inner surface 144. The first chamber 148 extends from the inner surface 144 to the middle ridge 152. The cooler port 136 is in fluid flow communication with the first chamber 148.

A second chamber 156 extends from the middle ridge 152 to the outlet end 120. The inner diameter of the second chamber 156 is greater than the inner diameter of the middle ridge 152, and similar to the diameter of the first chamber 148. The second chamber 156 is in fluid flow communication with the cooler return 140 and the outlet port 128.

The valve 86 includes the spool 108 disposed within the housing 104. The spool 108 has a generally cylindrical shape, and moves within the housing 104 in an axial direction between a non-actuated position, as shown in FIG. 3, and an actuated position, as shown in FIG. 4. When moving from the non-actuated position (FIG. 3) to the actuated position (FIG. 4), the spool 108 moves away from the outlet end 120 and toward the inlet end 116. Conversely, the spool 108 moves away from the inlet end 116 and toward the outlet end 120 when moving from the actuated position (FIG. 4) to the non-actuated position (FIG. 3). In the illustrated embodiment, a spring 160 contacts the inlet end 116 and the spool 108, and biases the spool 108 toward the non-actuated position (FIG. 3).

The spool 108 includes an inlet section 164 and an outlet section 168. The inlet section 164 is disposed at the end of the spool 108 near the inlet end 116, and the outlet section 168 is disposed at the end of the spool 108 near the outlet end 120. The spool 108 has an intermediate wall 172 that separates the in let section 164 and outlet section 168.

The inlet section 168 is substantially cylindrical and has a cylindrical outer wall 176. The outer wall 176 intersect s the intermediate wall 172, and extends from the perimeter of the intermediate wall 172 in a generally axial direction. In the illustrated embodiment, the intermediate wall 172 is substantially circular, and the outer wall 176 and intermediate wall 172 have substantially the same outer diameter. The outer diameter of the outer wall 176 and intermediate wall 172 are substantially the same as the inner diameter of the inner surface 144 and the middle ridge 152 to create seals between the various components of the housing 104 and spool 108. The inlet section 168 has an open end 180 at the end of the outer wall 176 opposite the intermediate wall 172. The open end 180 is open and permits fluid flow to enter the inlet section 168.

The inlet section 168 has at least one aperture 184 in the outer wall 176 near the intermediate wall 172. In the illustrated embodiment, there are multiple apertures 184 spaced around the perimeter of the outer wall 176 near the intermediate wall 172. The apertures 184 permit fluid flow to exit the inlet section 168.

The outlet section 168 has an end wall 188 disposed at the end of the spool 108 near the outlet end 120. At least one column 192 extends from the intermediate wall 172 to the end wall 188 to support the end wall 188. FIGS. 3 and 4 illustrate two columns 192 extending from the intermediate wall 172 to the end wall 188.

The spool 108 includes a temperature sensitive body disposed in the outlet section 168 that senses fluid temperature. In the illustrated embodiment, the temperature sensitive body is a wax cartridge 196. The wax cartridge 196 is interconnected to the end wall 188, and includes a main body 200 and an actuating member 204. In the illustrated embodiment, the main body 200 is cylindrical and extends through the end wall 188. The main body 200 is at least partially disposed between the columns 192. Fluid is able to flow between the columns 192 and contact the main body 200, and the wax cartridge 196 senses fluid temperature. The actuating member 204 extends from the main body 200 and contacts the outlet end 120. The actuating member 204 moves the spool 108 between the non-actuated position (FIG. 3 and the actuated position (FIG. 4).

Since the wax cartridge 196 is disposed in the outlet section 168, the wax cartridge 196 senses the outlet fluid temperature of fluid flowing through the outlet section 168, and the outlet fluid temperature influences the wax cartridge 196. If the outlet fluid temperature is below a predetermined level, the actuating member 204 contracts, and the spring 160 biases the spool 108 toward the non-actuated position (FIG. 3). If the outlet fluid temperature is above a predetermined level, the heat of the fluid contacting the wax cartridge 196 causes the actuating member 204 to expand and force the spool 108 away from the outlet end 120 against the biasing force of the spring 160, and toward the actuated position (FIG. 4).

The wax cartridge 196 senses the fluid temperature, and determines if the fluid temperature is above or below the predetermined level. If the temperature is below the predetermined level, the valve 86 bypasses the cooler 90 and directs the fluid back to the fluid system 70. If the temperature is above the predetermined level, the valve 86 directs the fluid to the cooler 90. As shown in FIG. 3, the valve 86 bypasses the cooler 90 and directs fluid flow through the outlet port 128 when the spool 108 is in the non-actuated position. As shown in FIG. 4, the valve 86 directs fluid flow to the cooler 90 when the spool 108 is in the actuated position.

In FIGS. 3 and 4, the arrows (A–K) represent the path of fluid flow through the valve 86. FIG. 3 illustrates the spool 108 in the non-actuated position where the valve 86 bypasses the cooler 90. The fluid flow A enters the valve 86 through the inlet port 124 from the fluid system 70. The fluid flow A proceeds into the inlet section 164 through the open end 180. In FIG. 3, the outer wall 176 extends between the middle ridge 152 and the inner surface 144, and contacts both the middle ridge 152 and the inner surface 144. The inner surface 144, outer wall 176, and middle ridge 152 seal off the first chamber 148, and prevent the fluid flow B from entering the first chamber 148 and flowing into the cooler 90.

Since the fluid flow B cannot enter the first chamber 148, the fluid flow C exits the inlet section 164 through the apertures 184. The apertures 184 are in fluid flow communication with the second chamber 156. Fluid flow C passes through the apertures 184, into the second chamber 156, and around the intermediate wall 172. Fluid flow D passes through the outlet section 168 and over the wax cartridge 196, and the wax cartridge 196 senses the temperature of the fluid flow D. Fluid flow E exits the valve 86 through the outlet port 128 and returns to the fluid system 70. The intermediate wall 172 shields the wax cartridge 196 from being directly influenced by the inlet fluid flow A, B, and the wax cartridge 196 senses the fluid temperature of the outlet fluid flow D, E.

As the fluid temperature increases, the wax cartridge 196 expands and moves the spool 108 toward the actuated position, as shown in FIG. 4. Fluid flow F enters the valve 86 from the fluid system 70 through the inlet port 124, and fluid flow G proceeds into the inlet section 164 through the open end 180. When the spool 108 is in the actuated position, the outer wall 176 contacts the inner surface 144, and the intermediate wall 172 contacts the middle ridge 152. The intermediate wall 172 and the middle ridge 152 create a seal that prevents the inlet flow F, G from directly entering the second chamber 156 from the inlet section 164.

In FIG. 4, the apertures 184 are in fluid flow communication with the first chamber 148. Fluid flow H exits the inlet section 164 through the apertures 184, flows through the first chamber 148, and exits the valve 86 through the cooler port 136. After the fluid exits the valve 86, the fluid passes through the cooler 90 which lowers the temperature of the fluid before the fluid reenters the valve 86. Fluid flow I reenters the valve 86 through the cooler return 140 and flows into the second chamber 156.

Fluid flow J passes through the outlet section 168 and second chamber 156, and contacts the wax cartridge 196. The wax cartridge 196 senses the temperature of the fluid flow J, and fluid flow K exits the valve 86 through the outlet port 128 and returns to the fluid system 70. Since the wax cartridge 196 is disposed in the outlet section 168, the seal between the intermediate wall 172 and middle ridge 152 shields the wax cartridge 196 from being influenced by the inlet fluid flow F, G. The wax cartridge 196 senses the outlet fluid temperature and is influenced by the outlet fluid flow I, J, K entering the valve 86 from the cooler 90. The wax cartridge 196 does not sense the inlet fluid temperature when the valve 86 is in the actuated position.

Figure 6:
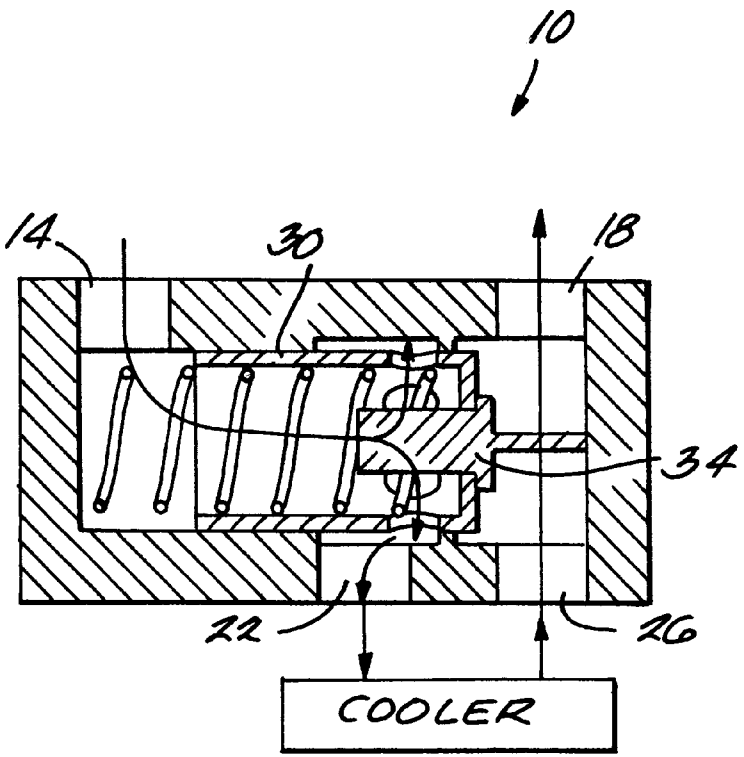
Fig. 6 PRIOR ART
FIG. 6 a cross-sectional view of the prior art thermal valve of FIG. 5.
Figure 5:
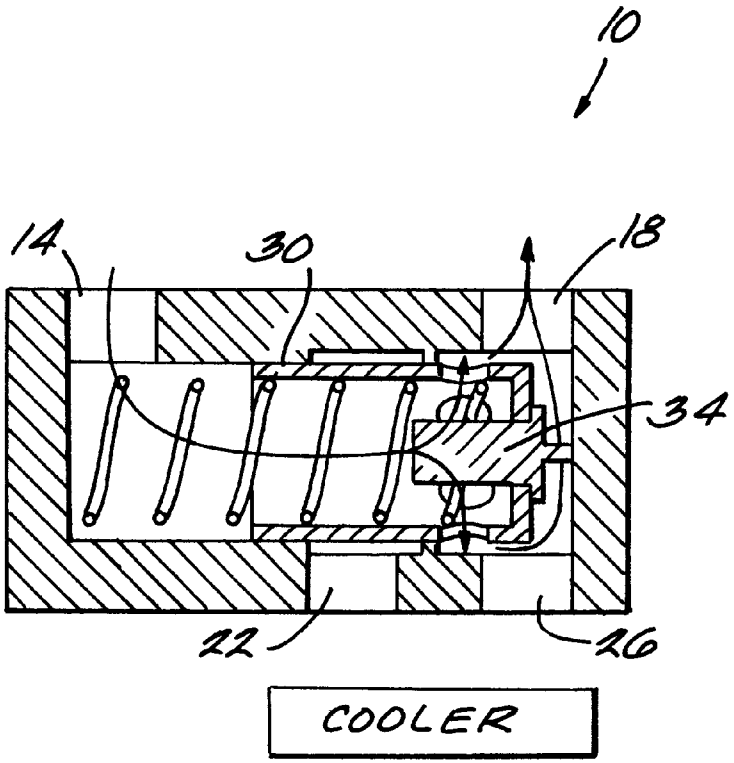
Fig. 5 PRIOR ART
FIG. 5 a cross-sectional view of a prior art thermal valve.

FIGS. 5 and 6 illustrate a prior art thermal valve 10 having a spool 30 and a wax cartridge 34. FIG. 5 illustrates the valve 10 in the non-actuated position, and FIG. 6 illustrates the valve 10 in the actuated position. In FIGS. 5 and 6, the wax cartridge 34 is directly influenced by the inlet fluid temperature when the valve 10 is in both the non-actuated position (FIG. 5) and the actuated position (FIG. 6). The prior art thermal valve 10 senses the inlet fluid temperature, and is generally a diverting valve.

Generally, the inlet fluid temperature is relatively unstable and fluctuates over a range of temperatures. In the prior art, as the inlet temperature fluctuates up and down, the wax cartridge 34 senses the inlet fluid temperature and moves the spool 30 back and forth between the actuated position and the non-actuated position. This fluctuation of the inlet temperature and movement of the spool 30 is undesirable because it creates additional wear and tear on the components of the valve 10, and inconsistent fluid flow through the cooler. The inlet temperature fluctuation also causes thermal cycling on the valve which creates additional stresses on the valve. Additionally, the fluctuation of the inlet temperature creates an inconsistent outlet temperature. In the prior art, the wax cartridge 34 senses the inlet fluid temperature when the spool 30 is in both the non-actuated position (FIG. 5) and the actuated position (FIG. 6).

As illustrated in FIG. 3, the intermediate wall 172 is disposed between the inlet port 124 and the wax cartridge 196, and the outer wall 176 prevents fluid flow from entering the first chamber 148. When the spool 108 is in the non-actuated position, the inlet fluid flow A, B, C flows around the intermediate wall 172 and into the second chamber 156. The fluid flow D then flows through the outlet section 168, and the wax cartridge 196 senses the outlet fluid temperature before the fluid flow E exits the valve 86 through the outlet port 128. When the spool 108 is in the non-actuated position (FIG. 3), inlet flow A, B, C enters the second chamber 156. The wax cartridge 196 senses the temperature of the outlet fluid flow D, E, and is influenced by the outlet fluid flow. In FIG. 3, the temperature of the inlet fluid flow A, B, C is similar to the temperature of the outlet fluid flow D, E.

If the fluid temperature increases above a predetermined level, the wax cartridge 196 expands, and moves the spool 108 toward the actuated position, as shown in FIG. 4. When the spool 108 is in the actuated position, the intermediate wall 172 creates a seal with the middle ridge 152 that prevents the inlet fluid flow F, G from entering the second chamber 156 and contacting the wax cartridge 196. Fluid flow H flows through the first chamber 148 and cooler port 136 to the cooler 90, and fluid flow I flows from the cooler 90 through the cooler return 140 and into the second chamber 156. The outlet fluid flow J then flows through the outlet section 168 and contacts the wax cartridge 196. The wax cartridge 196 senses the outlet fluid temperature before the outlet fluid flow K exits the valve 86 through the outlet port 128.

When the spool 108 is in the actuated position (FIG. 4), the inlet flow F, G, H does not contact the wax cartridge 196, and is directed to the cooler 90. The outlet fluid flow I, J, K flows through the outlet section 168 and contacts the wax cartridge 196. The wax cartridge 196 senses the outlet fluid flow temperature and is influenced by the outlet fluid flow I, J, K. When the spool 108 is in the actuated position (FIG. 4), the wax cartridge 196 does not sense inlet fluid flow temperature and is not influenced by the inlet fluid flow F, G, H. Only fluid flow that has passed through the cooler 90 influences the wax cartridge 196 when the spool 108 is in the actuated position (FIG. 4).

As mentioned above, the temperature of the inlet fluid flow from the fluid system 70 is unstable, and fluctuates over a range of temperatures. The temperature of the outlet fluid flow I, J, K from the cooler 90 is relatively stable. Therefore, the outlet fluid temperature provides a more stable influence on the wax cartridge 196 than the inlet fluid temperature. The valve 86 configuration illustrated in FIGS. 3 and 4 allows for a more stable control of the valve 86 than prior art valves. The wax cartridge 196 only senses the stable outlet fluid temperature when the spool 108 is in the actuated position (FIG. 4). Therefore, the wax cartridge 196 does not move the spool 108 between the actuated position and non-actuated position as frequently as the prior art valve 10, illustrated in FIGS. 5 and 6, which senses the unstable inlet fluid temperature when the spool 30 is in the actuated position.

In FIGS. 3 and 4, and as mentioned above, the valve 86 is usually in the non-actuated position (FIG. 3) when the compressor system first starts up, and generally moves to the actuated position (FIG. 4) after the compressor has run for a period of time and the fluid temperature reaches a predetermined level. The inlet fluid temperature from the fluid system 70 is generally higher than the outlet fluid temperature from the cooler 90. In FIG. 4, the wax cartridge 196 senses the relatively cool, stable outlet fluid temperature in the actuated position, but in FIG. 6 the prior art wax cartridge 34 senses the hot, unstable inlet temperature in the actuated position. The prior art wax cartridge 34 of FIG. 6 is generally exposed to higher fluid temperatures than the wax cartridge 196 of FIG. 4. Therefore, the wax cartridge 196 of FIG. 4 is set to actuate the spool 108 at a different temperature range than the prior art wax cartridge 196 of FIG. 6. The predetermined level for the wax cartridge 196 of FIG. 4 is calibrated to be lower than the predetermined level for the prior art wax cartridge 34 of FIG. 6. Accordingly, the wax cartridge 196 of FIG. 4 will move the spool 108 to the actuated position at a lower temperature than the prior art wax cartridge 34 of FIG. 6.

What is claimed is:

1. A compressor system comprising:

an airend for compressing air;

a cooler connected to the airend and for receiving fluid from the airend and for selectively cooling that fluid; and a valve that controls fluid flow to the cooler, the valve including:

a housing comprising an inlet end at a first end of the housing, and an outlet end at the end of the housing opposite the inlet end, wherein an inlet port is disposed near the inlet end, an outlet port is disposed near the outlet end, a cooler return is disposed near the outlet end, and a cooler port is disposed between the inlet end and the outlet end, and an inner diameter of the housing varies along the axial length of the housing between the inlet end and the outlet end, wherein an inlet fluid flow enters the valve through the inlet port; and a spool disposed within the housing, the spool including an inlet section disposed near the inlet end, an outlet section disposed near the outlet end, and an intermediate wall separating the inlet section from the outlet section, the spool being movable between a non-actuated position and an actuated position, wherein the valve directs fluid flow to the cooler when the spool is in the actuated position, and the valve bypasses fluid flow from the cooler when the spool is in the non-actuated position, the spool having a temperature sensitive body that senses the temperature of fluid passing over the temperature sensitive body, and moves the spool between the non-actuated position and the actuated position based on the fluid temperature, the outlet section including:

an end wall disposed at the end of the outlet section opposite the intermediate wall and near the outlet end;

at least one column extending from the intermediate wall to the end wall; and the temperature sensitive body interconnected to the end wall and disposed between the intermediate wall and the end wall.

2. The compressor system of claim 1, wherein the housing further includes:

an inner surface defining the inner diameter of the housing near the inlet end, and extending from the inlet end to the cooler port;

a middle ridge disposed between the cooler port and the cooler return, wherein the inner diameter of the middle ridge is substantially the same as the inner diameter of the inner surface;

a first chamber extending between the inner surface and the middle ridge, wherein the inner diameter of the first chamber is greater than the inner diameter of the inner surface, and the cooler port is in fluid flow communication with the first chamber;

a second chamber extending between the middle ridge and the outlet end, wherein the inner diameter of the second chamber is greater than the inner diameter of the inner surface, and the cooler return and outlet port are in fluid flow communication with the second chamber.

3. The compressor system of claim 2, wherein the spool creates a seal with the middle ridge when the spool is in the actuated position to prevent the inlet fluid flow from entering the second chamber and influencing the temperature sensitive body.

4. The compressor system of claim 2, wherein the inlet section is substantially cylindrical and further includes:

a cylindrical tubular outer wall that intersects with the intermediate wall, wherein the outer diameter of the intermediate wall is substantially the same as the outer diameter of the outer wall;

an open end disposed at the end of the outer wall opposite the intermediate wall and near the inlet end, wherein the open end permits the inlet fluid flow to enter the inlet section; and at least one aperture in the outer wall near the intermediate wall that permits the inlet fluid flow to exit the inlet section.

5. The compressor system of claim 4, wherein the at least one aperture is in fluid flow communication with the first chamber when the spool is in the actuated position.

6. The compressor system of claim 4, wherein the at least one aperture is in fluid flow communication with the second chamber when the spool is in the non-actuated position.

7. The compressor system of claim 4, wherein the intermediate wall is disposed between the at least one aperture and the temperature sensitive body.

8. The compressor system of claim 2, wherein the intermediate wall creates a seal with the middle ridge to prevent the inlet fluid flow from entering the second chamber and influencing the temperature sensitive body.

9. The compressor system of claim 1, wherein the temperature sensitive body is exposed to the inlet fluid flow only when the spool is in the non-actuated position.

10. The compressor system of claim 5, wherein the temperature sensitive body is a wax cartridge.

11. A compressor system comprising:

a fluid system for circulating fluids through the compressor system, wherein the fluid system includes a cooler and a valve that controls fluid flow to the cooler, the valve comprising:

a cylindrical tubular housing including:

an inlet end at a first end of the housing, an outlet end at the end of the housing opposite the inlet end, an inlet port disposed near the inlet end, wherein an inlet fluid flow enters the valve through the inlet port, an outlet port disposed near the outlet end, a cooler return disposed near the outlet end, and directs fluid flow from the cooler to the valve, a cooler port disposed between the inlet end and the outlet end, and directs fluid flow from the valve to the cooler, an inner surface defining the inner diameter of the housing near the inlet end, and extending from the inlet end to the cooler port, a middle ridge disposed between the cooler port and the cooler return, wherein the inner diameter of the middle ridge is substantially the same as the inner diameter of the inner surface, a first chamber extending between the inner surface and the middle ridge, wherein the inner diameter of the first chamber is greater than the inner diameter of the inner surface, and the cooler port is in fluid flow communication with the first chamber, and a second chamber extending between the middle ridge and the outlet end, wherein the inner diameter of the second chamber is greater than the inner diameter of the inner surface, and the cooler return and outlet port are in fluid flow communication with the second chamber;

a spool disposed within the housing, and movable between a non-actuated position and an actuated position, the spool including:

a substantially cylindrical inlet section disposed near the inlet end and having, a cylindrical tubular outer wall, an open end disposed at the end of the outer wall near the inlet end, wherein the open end permits the inlet fluid flow to enter the inlet section, an intermediate wall disposed at the end of the outer wall opposite the open end, and at least one aperture in the outer wall near the intermediate wall that permits the inlet fluid flow to exit the inlet section, an outlet section disposed near the outlet end, wherein the intermediate wall separates the inlet section from the outlet section, the outlet section having an end wall disposed at the end of the outlet section opposite the intermediate wall and near the outlet end, at least one column extending from the intermediate wall to the end wall, and a temperature sensitive body interconnected to the end wall and substantially disposed between the intermediate wall and the end wall, and the intermediate wall is disposed between the at least one aperture and the temperature sensitive body, and the temperature sensitive body has an actuating member that extends from the temperature sensitive body and contacts the outlet end; and wherein the at least one aperture is in fluid flow communication with the first chamber when the spool is in the actuated position, and the at least one aperture is in fluid flow communication with the second chamber when the spool is in the non-actuated position.

12. The compressor system of claim 11, wherein the valve directs fluid flow to the cooler when the spool is in the actuated position, and the valve bypasses fluid flow from the cooler when the spool is in the non-actuated position.

13. The compressor system of claim 11, wherein the temperature sensitive body senses the temperature of fluid passing over the temperature sensitive body, and moves the spool between the non-actuated position and the actuated position based on the fluid temperature, wherein the wax cartridge senses the temperature of the inlet fluid flow only when the spool is in the non-actuated position.

14. The compressor system of claim 13, wherein the temperature sensitive body moves the spool toward the actuated position when the temperature sensitive body senses a fluid temperature above a predetermined level, and the temperature sensitive body moves the spool toward the non-actuated position when the temperature sensitive body senses a fluid temperature below a predetermined level.

15. The compressor system of claim 11, wherein the valve further includes a spring that contacts the spool and the inlet end and biases the spool toward the non-actuated position.

16. The compressor system of claim 11, wherein the outer wall contacts the inner surface and middle ridge to prevent the inlet fluid flow from entering the first chamber when the spool is in the non-actuated position.

17. The compressor system of claim 11, wherein the intermediate wall contacts the middle ridge to prevent the inlet fluid flow from entering the second chamber when the spool is in the actuated position.

18. The compressor system of claim 11, wherein the temperature sensitive body is disposed within the second chamber.

19. The compressor system of claim 11, wherein the temperature sensitive body is a wax cartridge.

20. The compressor system of claim 11, wherein when the spool is in the actuated position, the inlet fluid flow enters the valve through the inlet port, flows through the inlet section and first chamber, and exits the valve through the cooler port and flows to the cooler, and an outlet fluid flow enters the valve through the cooler return from the cooler, flows through the outlet section and second chamber, contacts the temperature sensitive body, and exits the valve through the outlet port.

21. The compressor system of claim 20, wherein the temperature sensitive body senses the temperature of the outlet fluid flow when the spool is in the actuated position.

22. The compressor system of claim 20, wherein the temperature sensitive body does not sense the temperature of the inlet fluid flow when the spool is in the actuated position.

23. A valve for use in a compressor, the valve comprising:

a housing including an inlet end at a first end of the housing, and an outlet end at the end of the housing opposite the inlet end, wherein an inlet port is disposed near the inlet end, an outlet port is disposed near the outlet end, a cooler return is disposed near the outlet end, and a cooler port is disposed between the inlet end and the outlet end, and an inner diameter of the housing varies along the axial length of the housing between the inlet end and the outlet end, wherein an inlet fluid flow enters the valve through the inlet port; and a spool disposed within the housing, the spool including an inlet section disposed near the inlet end, an outlet section disposed near the outlet end, and an intermediate wall separating the inlet section from the outlet section, the spool being movable between a non-actuated position and an actuated position, the spool having a temperature sensitive body that senses the temperature of fluid passing over the temperature sensitive body, and moves the spool between the non-actuated position and the actuated position based on the fluid temperature, the outlet section including:

an end wall disposed at the end of the outlet section opposite the intermediate wall and near the outlet end;

at least one column extending from the intermediate wall to the end wall; and the temperature sensitive body interconnected to the end wall and disposed between the intermediate wall and the end wall.

24. The valve of claim 23, wherein the housing further includes:

an inner surface defining the inner diameter of the housing near the inlet end, and extending from the inlet end to the cooler port;

a middle ridge disposed between the cooler port and the cooler return, wherein the inner diameter of the middle ridge is substantially the same as the inner diameter of the inner surface;

a first chamber extending between the inner surface and the middle ridge, wherein the inner diameter of the first chamber is greater than the inner diameter of the inner surface, and the cooler port is in fluid flow communication with the first chamber;

a second chamber extending between the middle ridge and the outlet end, wherein the inner diameter of the second chamber is greater than the inner diameter of the inner surface, and the cooler return and outlet port are in fluid flow communication with the second chamber.

25. The valve of claim 24, wherein the spool creates a seal with the middle ridge when the spool is in the actuated position to prevent the inlet fluid flow from entering the second chamber and influencing the temperature sensitive body.

26. The valve of claim 24, wherein the intermediate wall creates a seal with the middle ridge to prevent the inlet fluid flow from entering the second chamber and influencing the temperature sensitive body.

27. The valve of claim 24, wherein the inlet section is substantially cylindrical and further includes:

a cylindrical tubular outer wall that intersects with the intermediate wall, wherein the outer diameter of the intermediate wall is substantially the same as the outer diameter of the outer wall;

an open end disposed at the end of the outer wall opposite the intermediate wall and near the inlet end, wherein the open end permits the inlet fluid flow to enter the inlet section; and at least one aperture in the outer wall near the intermediate wall that permits the inlet fluid flow to exit the inlet section.

28. The valve of claim 27, wherein the intermediate wall is disposed between the at least one aperture and the temperature sensitive body.

29. The valve of claim 27, wherein the at least one aperture is in fluid flow communication with the first chamber when the spool is in the actuated position.

30. The valve of claim 27, wherein the at least one aperture is in fluid flow communication with the second chamber when the spool is in the non-actuated position.

31. The valve of claim 23, wherein the temperature sensitive body temperature is exposed to the inlet fluid flow only when the spool is in the non-actuated position.

32. The valve of claim 23, wherein the temperature sensitive body is a wax cartridge.

* * * * *